US008474171B1

(12) United States Patent
Simmons

(10) Patent No.: US 8,474,171 B1
(45) Date of Patent: Jul. 2, 2013

(54) BREACH LOCK

(76) Inventor: Alan Simmons, Marysville, WA (US)

( * ) Notice: Subject to any disclaimer, the term of this patent is extended or adjusted under 35 U.S.C. 154(b) by 64 days.

(21) Appl. No.: 13/210,416

(22) Filed: Aug. 16, 2011

(51) Int. Cl.
*F41A 29/00* (2006.01)

(52) U.S. Cl.
USPC ..... 42/95; 42/70.11; 42/108

(58) Field of Classification Search
USPC ..... 42/70.11, 90, 95, 106, 108
See application file for complete search history.

(56) References Cited

U.S. PATENT DOCUMENTS

| | | | |
|---|---|---|---|
| D32,245 | S | 2/1900 | Nightingale |
| 2,741,011 | A | 4/1956 | Kuper |
| D254,976 | S | 5/1980 | Valente |
| 5,682,700 | A | 11/1997 | Sandberg |
| 7,644,529 | B2 | 1/2010 | Hopper |
| 7,703,232 | B1 | 4/2010 | Johns |
| 7,886,474 | B2 | 2/2011 | Werner |
| 8,347,542 | B2 * | 1/2013 | Rich ..... 42/96 |
| 2006/0168870 | A1 | 8/2006 | Haponski |
| 2009/0193703 | A1 | 8/2009 | Riley |

OTHER PUBLICATIONS

AR-15 Cleaning Link. <http://1919a4.com/showthread.php?22629-WTS-AR-15-Cleaning-Link-12-Shipped>. Feb. 11, 2009.*

* cited by examiner

*Primary Examiner* — Gabriel Klein
(74) *Attorney, Agent, or Firm* — Kyle Fletcher

(57) ABSTRACT

The breach lock is for use in securing open the breach of an assault rifle during cleaning of the bolt action and the breach between uses of the assault rifle. The breach lock includes a notch along a top of the breach lock and a hole along the breach lock, which define a length. The breach lock is inserted between the upper receiver assembly and the lower receiver assembly so as to prevent any rotation there between. The notch bolts to the upper receiver assembly whereas the hole employs the pin of the assault rifle to engage the lower receiver assembly. The breach lock is simple in installation and removal with use of an assault rifle, and prevents unwanted collapse between the upper and lower receiver assemblies, which would otherwise pinch or injure the hand and fingers of an end user when cleaning.

10 Claims, 3 Drawing Sheets

BREACH LOCK

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of guns and firearms, more specifically, a lock specifically adapted for supporting the breach of an assault rifle in an open position for use during cleaning of the bolt action and breach between uses, and for removal or replacement of parts and components.

When using an assault rifle, dirt and grime accumulates inside of the breach and on the bolt action, which needs to be cleaned periodically in order to maintain proper working function of said parts. When the need arises to clean out these parts of the assault rifle, a pin has to be removed. The pin is responsible for securement of the upper receiver assembly to the lower receiver assembly. Upon removal of the pin, the upper receiver assembly rotates with respect to the lower receiver assembly thereby exposing the breach and the bolt action.

It is important to note that the main need for use of the breach lock is to prevent unwanted collapse of the upper receiver assembly onto the lower receiver assembly when cleaning out the breach and bolt action, which otherwise would result in pinching of the hands and fingers. There is a need for a breach lock that secures the upper receiver assembly at an angle with respect to the lower receiver assembly so as to lock open and expose the breach for access during cleaning and/or repair.

B. Discussion of the Prior Art

As a preliminary note, it should be stated that there is an ample amount of prior art that deals with firearms, generally. However, no prior art discloses a breach lock that holds in an open position the breach of an assault rifle by engaging between the upper receiver assembly and the lower receiver assembly; wherein the breach lock features a notch along a top portion through which a bolt and wing nut slide there through so as to engage and lock the upper receiver assembly to the breach lock whereas a bottom of the breach lock includes a hole through which the pin of the assault rifle passes across in conjunction with the lower receiver assembly; wherein the breach lock is defined by a length that opens the breach in a lock position for use in cleaning the breach and bolt action between uses.

The Johns Patent (U.S. Pat. No. 7,703,232) discloses a handgun bushing tool. However, the handgun bushing tool is not specifically adapted for use in supporting the breach of an assault rifle in a locked and open position, and is positioned between the upper receiver assembly and the lower receiver assembly.

The Haponski et al. Patent Application Publication (U.S. Pub. No. 2006/0168870) discloses a tool for disassembly of rifles. However, the tool is not a lock that secures the breach of an assault rifle in an open position by engaging between the upper receiver assembly and the lower receiver assembly.

The Hopper Patent (U.S. Pat. No. 7,644,529) discloses a rifle bolt cleaning tool. However, the cleaning tool is only responsible for cleaning the bolt action of a rifle, and is not capable of locking the breach of an assault rifle in an open position by engaging between the upper receiver assembly and the lower receiver assembly.

The Kuper Patent (U.S. Pat. No. 2,741,011) discloses a breach block removing tool. Again, the breach block removing tool is responsible for removal of the breach block and is not a lock that locks in an open position the breach formed between the upper receiver assembly and the lower receiver assembly of an assault rifle.

The Riley Patent Application Publication (U.S. Pub. No. 2009/0193703) discloses a collapsible gun cleaning kit. However, the kit does not support the breach of an assault rifle in an open position by engaging between the upper receiver assembly and the lower receiver assembly.

The Sandberg Patent (U.S. Pat. No. 5,682,700) discloses a rifle cleaning cradle. However, the rifle cleaning cradle is not a breach lock that locks open the breach by engaging between the upper receiver assembly and the lower receiver assembly of an assault rifle.

The Werner Patent (U.S. Pat. No. 7,886,474) discloses a rest for cleaning a rifle. Again, the rest is only responsible for supporting the entire rifle during cleaning or for sighting a scope, and is not a breach lock that secures the breach in an open position during cleaning by engaging between the upper receiver assembly and the lower receiver assembly.

The Nightingale Patent (U.S. Pat. No. Des. 32,245) illustrates an ornamental design for a pick guard, which does not depict a breach lock for securing a breach in an open position of an assault rifle.

While the above-described devices fulfill their respective and particular objects and requirements, they do not describe a breach lock that holds in an open position the breach of an assault rifle by engaging between the upper receiver assembly and the lower receiver assembly; wherein the breach lock features a notch along a top portion through which a bolt and wing nut slide there through so as to engage and lock the upper receiver assembly to the breach lock whereas a bottom of the breach lock includes a hole through which the pin of the assault rifle passes across in conjunction with the lower receiver assembly; wherein the breach lock is defined by a length that opens the breach in a lock position for use in cleaning the breach and bolt action between uses, and removal or replacement of parts and/or components. In this regard, the breach lock departs from the conventional concepts and designs of the prior art.

SUMMARY OF THE INVENTION

The breach lock is for use in securing open the breach of an assault rifle during cleaning of the bolt action and the breach between uses of the assault rifle. The breach lock includes a notch along a top of the breach lock and a hole along the breach lock, which define a length. The breach lock is inserted between the upper receiver assembly and the lower receiver assembly so as to prevent any rotation there between. The notch bolts to the upper receiver assembly whereas the hole employs the pin of the assault rifle to engage the lower receiver assembly. The breach lock is simple in installation and removal with use of an assault rifle, and prevents unwanted collapse between the upper and lower receiver assemblies, which would otherwise pinch or injure the hand and fingers of an end user when cleaning.

An object of the invention is to provide a lock that secures the breach of an assault rifle in an open position for use during cleaning of the breach and the bolt action of said assault rifle.

A further object of the invention is to provide a breach lock that is specifically adapted for bolting onto both the upper receiver assembly and the lower receiver assembly when rotated to expose the breach.

A further object of the invention is to provide a breach lock that is of simple construction, and simply installs and removes from the upper receiver assembly and the lower receiver assembly.

An even further object of the invention is to remove the pin connecting between the upper receiver assembly and the lower receiver assembly, and thereafter use said pin to secure the breach lock to the lower receiver assembly.

These together with additional objects, features and advantages of the breach lock will be readily apparent to those of ordinary skill in the art upon reading the following detailed description of presently preferred, but nonetheless illustrative, embodiments of the breach lock when taken in conjunction with the accompanying drawings.

In this respect, before explaining the current embodiments of the breach lock in detail, it is to be understood that the breach lock is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the breach lock.

It is therefore important that the claims be regarded as including such equivalent construction insofar as they do not depart from the spirit and scope of the breach lock. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations.

All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
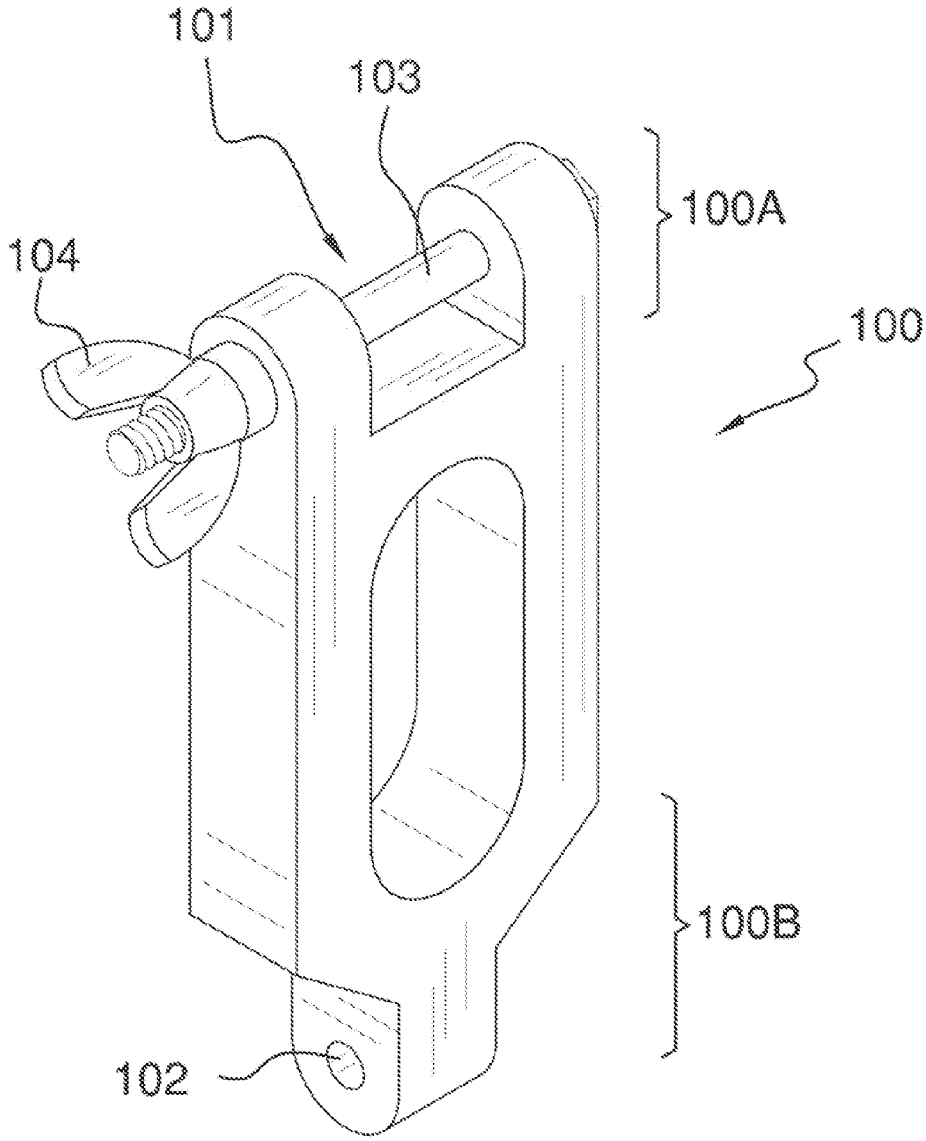
FIG. 1 illustrates a perspective view of the breach lock by itself wherein the bolt and wing nut are installed onto the breach lock.
Figure 2:
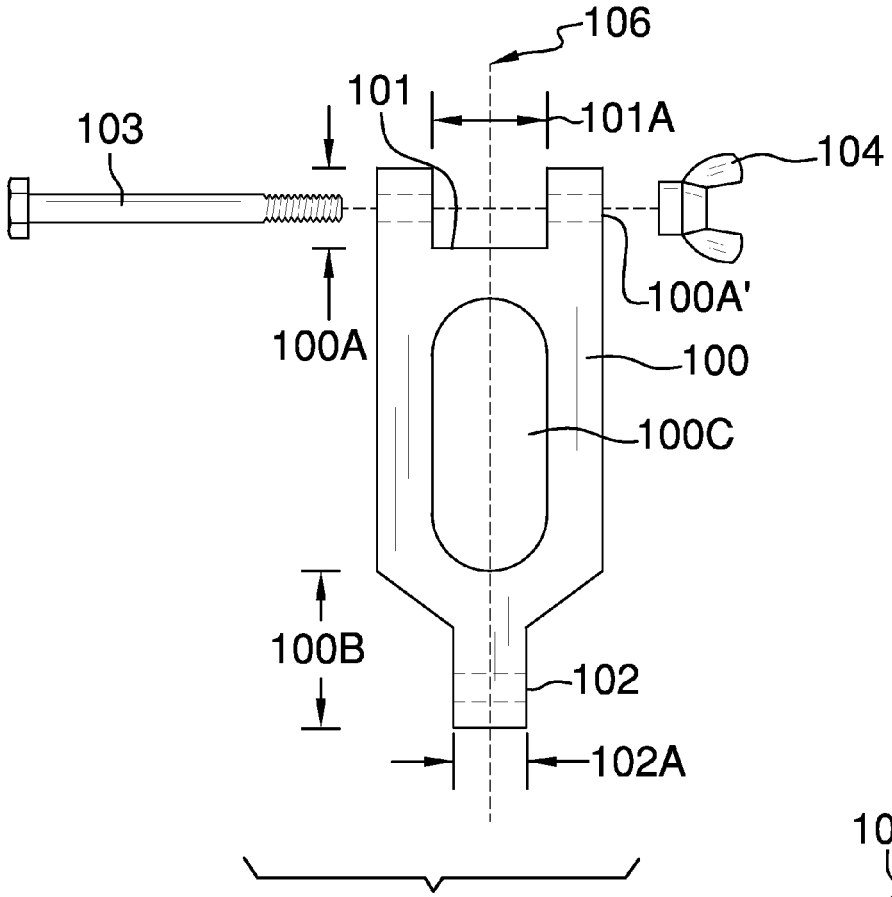
FIG. 2 illustrates a front, exploded view of the breach lock wherein the bolt and lock are removed from the breach lock.
Figure 3:
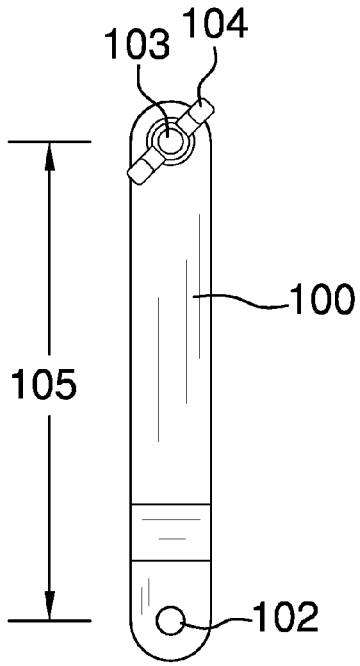
FIG. 3 illustrates a side view of the breach lock by itself.
Figure 4A:
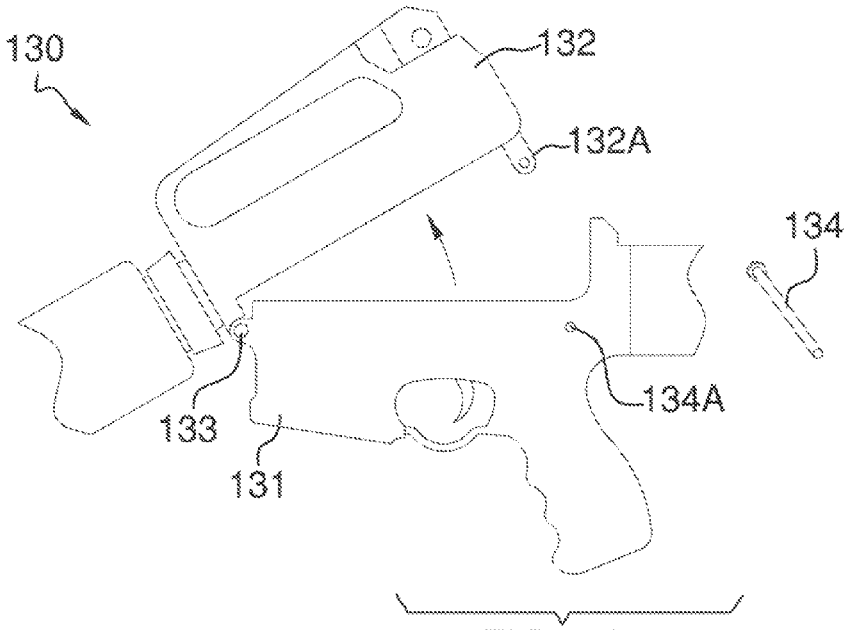
FIG. 4A illustrates a side view of an assault rifle wherein the breach is opened after removing the pin and rotating the upper receiver assembly with respect to the lower receiver assembly.
Figure 4B:
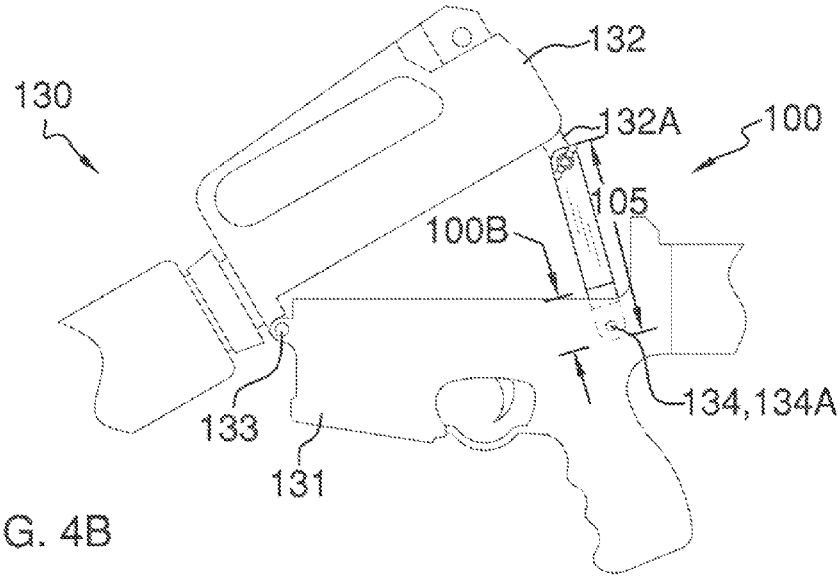
FIG. 4B illustrates a side view of the breach lock installed between the upper receiver assembly and the lower receiver assembly; wherein the pin of the assault rifle is inserted across both the lower receiver assembly and the hole of the breach lock whereas the bolt and wing nut are used to secure the upper receiver assembly to the notch of the breach lock.

Detailed reference will now be made to the preferred embodiment of the present invention, examples of which are illustrated in FIGS. 1-4B. A breach lock 100 (hereinafter invention) includes a notch 101 that is located at a top portion 100A of the breach lock 100. The breach lock 100 includes a longitudinal axis 106. The breach lock 100 includes a hole 102 that is located at a bottom portion 100B of the breach lock 100. It shall be noted that the bottom portion 100B of the breach lock 100 and the hole 102 have a width 102A that is less than or equal to the width of a lower receiver assembly 131 of an assault rifle 130 such that the bottom portion 100B can slide into the cavity that forms a breach of the assault rifle 130.

It shall be noted that the notch 101 of the top portion 100A of the breach lock 100 has a width 101A that is greater than or equal to a pin engaging member 132A of an upper receiver assembly 132 of the assault rifle 130.

It shall be further noted that the construction of the assault rifle 130 includes a pivot point 133 that connects between both the upper receiver assembly 132 and the lower receiver assembly 131 such that the upper receiver assembly 132 can rotate with respect to the lower receiver assembly 131. The pivot point 133 enables access to the breach and bolt action located between the upper receiver assembly 132 and the lower receiver assembly 131.

The assault rifle 130 includes a pin 134 that slides across a pin hole 134A located on the lower receiver assembly 131 and the pin engaging member 132A of the upper receiver assembly 132. The pin 134 is responsible for securing the upper receiver assembly 132 onto the lower receiver assembly 131 when the assault rifle 130 is in use.

In order to use the invention 100, the pin 134 is first removed, and then the upper receiver assembly 132 is rotated with respect to the lower receiver assembly 131 in order to expose the breach formed therein. The invention 100 includes a bolt 103 and wing nut 104, which are used to bolt the notch 101 and top portion of the breach lock 100 to the upper receiver assembly 132; whereas the pin 134 is used to secure the breach lock 100 to the lower receiver assembly 131 via the hole 102 located on the bottom portion 100B.

On opposing sides of the top portion 100A are top holes 100A'. The top holes 100A' enable the bolt 103 to slide across both the breach lock 100 and the upper receiver assembly 132. It shall be noted that the top holes 100A' have a diameter that is greater than or equal to the bolt 103.

It shall be noted that the hole 102 shall have a diameter that is greater than or equal to the diameter of the pin 134. Ideally, it shall be further noted that the diameter of the holes 102 shall have a diameter at least 0.002 inches greater than the diameter of the pin 134.

It shall be noted that a distance 105 is defined between the notch 101 and the hole 102. The distance 105 shall range depending upon the style and manufacture of the assault rifle 130. The distance 105 also dictates the range of exposure of the breach located between the upper receiver assembly 132 and the lower receiver assembly 131.

It shall be further noted that the breach lock 100 may feature an opening 100C, which provides greater access to the breach formed between the upper receiver assembly 132 and the lower receiver assembly 131. The opening 100C also lowers the overall materials used in the construction of the invention 100. It shall also be noted that the breach lock 100 may be made of different materials comprising plastic, wood, metal, carbon fiber composite.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A breach lock for an assault rifle comprising: a top portion, a bottom portion, and a longitudinal axis extending through both the top portion and the bottom portion;

a bolt and wing nut for engaging the top portion of the breach lock to an upper receiver assembly of said assault rifle;

wherein the bottom portion of the breach lock is secured to a lower receiver assembly of an assault rifle via a pin;

wherein the breach lock secures the upper receiver assembly at an angle with respect to the lower receiver assembly thereby exposing a breach formed therein for cleaning purposes;

wherein the bottom portion includes a hole for receiving the pin;

wherein on opposing sides of the top portion are top holes, which enable the bolt to slide across both the breach lock and the upper receiver assembly; wherein the top portion of the breach lock includes a notch extending toward the bottom portion to a location below the top holes;

wherein the breach lock includes an opening separated from the notch and extending completely through the breach lock in a direction perpendicular to the longitudinal axis;

wherein the top holes of the top portion are parallel with the hole of the bottom portion;

wherein the top holes of the top portion and the hole of the bottom portion are perpendicular with and separated via the opening of the breach lock.

2. The breach lock as described in claim 1 wherein the hole has a diameter that is greater than or equal to the diameter of the pin.

3. The breach lock as described in claim 1 wherein the hole has a width that is less than or equal to the width of the breach formed within the lower receiver assembly.

4. The breach lock as described in claim 3 wherein the notch has a width that is greater than or equal to a pin engaging member of the upper receiver assembly.

5. The breach lock as described in claim 4 wherein the top holes have a diameter that is greater than or equal to the bolt.

6. The breach lock as described in claim 4 wherein a distance is formed between the notch and the hole, which defines the angle formed between the upper receiver assembly and the lower receiver assembly.

7. A breach lock for an assault rifle comprising: a top portion, a bottom portion, and a longitudinal axis extending through both the top portion and the bottom portion;

a bolt and wing nut for engaging the top portion of the breach lock to an upper receiver assembly of said assault rifle;

wherein the bottom portion of the breach lock is secured to a lower receiver assembly of an assault rifle via a pin;

wherein the breach lock secures the upper receiver assembly at an angle with respect to the lower receiver assembly thereby exposing a breach formed therein for cleaning purposes;

wherein the bottom portion includes a hole for receiving the pin;

wherein on opposing sides of the top portion are top holes, which enable the bolt to slide across both the breach lock and the upper receiver assembly; wherein the top portion of the breach lock includes a notch extending toward the bottom portion to a location below the top holes; wherein the breach lock includes an opening separated from the notch and extending completely through the breach lock in a direction perpendicular to the longitudinal axis;

wherein the top holes of the top portion are parallel with the hole of the bottom portion;

wherein the top holes of the top portion and the hole of the bottom portion are perpendicular with and separated via the opening of the breach lock;

wherein the hole of the bottom portion has a diameter that is greater than or equal to the diameter of the pin;

wherein the hole of the bottom portion has a width that is less than or equal to the width of the breach formed within the lower receiver assembly;

wherein the notch has a width that is greater than or equal to a pin engaging member of the upper receiver assembly.

8. The breach lock as described in claim 7 wherein the top holes have a diameter that is greater than or equal to the bolt.

9. The breach lock as described in claim 7 wherein a distance is formed between the notch and the hole, which defines the angle formed between the upper receiver assembly and the lower receiver assembly.

10. A breach lock for an assault rifle comprising: a top portion, a bottom portion, and a longitudinal axis extending through both the top portion and the bottom portion;

a bolt and wing nut for engaging the top portion of the breach lock to an upper receiver assembly of said assault rifle;

wherein the bottom portion of the breach lock is secured to a lower receiver assembly of an assault rifle via a pin;

wherein the breach lock secures the upper receiver assembly at an angle with respect to the lower receiver assembly thereby exposing a breach formed therein for cleaning purposes;

wherein the bottom portion includes a hole for receiving the pin;

portion of the breach lock includes a notch; with wherein on opposing sides of the top portion are top holes, which enable the bolt to slide across both the breach lock and the upper receiver assembly; wherein the top holes have a diameter that is greater than or equal to the bolt; wherein the top portion of the breach lock includes a notch extending toward the bottom portion to a location below the top holes; wherein the notch has a width that is greater than or equal to a pin engaging member of the upper receiver assembly; wherein the breach lock includes an opening separated from the notch and extending completely through the breach lock in a direction perpendicular to the longitudinal axis;

wherein the hole of the bottom portion has a diameter that is greater than or equal to the diameter of the pin; wherein the hole of the bottom portion has a width that is less than or equal to the width of the breach formed within the lower receiver assembly;

wherein the top holes of the top portion are parallel with the hole of the bottom portion;

wherein the top holes of the top portion and the hole of the bottom portion are perpendicular with and separated via the opening of the breach lock.

* * * * *